US005920925A

United States Patent [19]

Dongo

[11] Patent Number: 5,920,925

[45] Date of Patent: Jul. 13, 1999

[54] PULSATING HYDROTHERAPY JET SYSTEM

[75] Inventor: Paul A. Dongo, Camarillo, Calif.

[73] Assignee: B&S Plastics, Inc., Oxnard, Calif.

[21] Appl. No.: 09/053,882

[22] Filed: Apr. 1, 1998

[51] Int. Cl.[6] ..... A61H 33/04

[52] U.S. Cl. ..... 4/541.6; 4/541.4; 4/541.1; 4/492; 239/601

[58] Field of Search ..... 4/541.1–541.6, 4/492, 567, 615; 239/590.5, 553.5, 601

[56] References Cited

U.S. PATENT DOCUMENTS

| | | | |
|---|---|---|---|
| 3,570,766 | 3/1971 | Johnson | 239/601 |
| 4,320,541 | 3/1982 | Neenan | 4/492 |
| 4,508,665 | 4/1985 | Spinnett | 261/93 |
| 5,226,601 | 7/1993 | Hinojosa, Jr. et al. | 239/423 |
| 5,444,879 | 8/1995 | Holtsnider | 4/541.01 |
| 5,457,825 | 10/1995 | Holtsnider | 4/541.1 |
| 5,657,496 | 8/1997 | Corb et al. | 4/541.6 |
| 5,742,953 | 4/1998 | Loizeaux et al. | 4/541.6 |

OTHER PUBLICATIONS

"Poly Jet Internals", *Waterway 1997 Product Catalog*, p. 2.
"The Wave" New Automatic Diverter Valve, Waterway Product Description Sheet.

*Primary Examiner*—Henry J. Recla
*Assistant Examiner*—Tuan Nguyen
*Attorney, Agent, or Firm*—Koppel & Jacobs

[57] ABSTRACT

The system includes a jet, a rotating member or "eyeball" and a diverter cap formed with a number of bore holes positioned at a common radius from the center of the cap. The jet produces a high pressure water jet that flows through the eyeball causing it to rotate at a high speed and discharge the jet in a circular pattern that impinges on the bore holes. The bore holes are formed in the diverter cap so that the upstream intersection of the bore holes forms a series of ridges that divert the rotating jet into the appropriate bore hole(s) without blocking the jet and producing a back flow and are aligned with the rotating eyeball to minimize pressure losses experienced by the jet. Together the rotation speed and bore hole design produce the sensation of a number of simultaneously pulsating water jets that are directed into the spa or tub. The system has the added advantage in that its design results in low pressure losses.

22 Claims, 9 Drawing Sheets

PULSATING HYDROTHERAPY JET SYSTEM

BACKGROUND OF THE INVENTION

1. Field of the Invention

The invention relates to a hydrotherapy jet system and more particularly, to the design of pulsating hydrotherapy jets.

2. Description of the Related Art

Various hydrotherapy jets have been developed in the past, for use in spas, hot tubs and bath tubs, that discharge an aerated stream of water through a variety of discharge nozzles. In general, such jets produce a constant flow stream which provides a good therapeutic effect. However, in an attempt to enhance the therapeutic effect, several systems have been designed that produce a pulsating flow. These systems have met with varying degrees of success as they often require additional or larger components, which increase system cost and add complexity, or they generate unwanted pressure losses, thus requiring a larger water pump then would otherwise be required.

One prior art approach has been to use mechanical devices to pulse the water flowing to an individual jet or a series of jets. An example of such a system is described in U.S. Pat. No. 4,320,541 to John S. Neenan. In this approach, a series of mechanical blocking devices are used to intermittently block and unblock the flow stream. As the flow stream is unblocked, a pulse of water is sent to the jet and ultimately to the user. While this approach does provide a pulsating effect, the blocking and unblocking of the flow stream causes abrupt pressure increases, imposing strain on spa systems. Aside from these drawbacks, such systems require additional components which add complexity, cost and weight. In addition, since the pulsation effect is generated away from the jet, the pulsed flow stream experiences pressure loss, resulting in a decreased pulsation effect being felt at the jet exit.

In an alternate approach, rather than using mechanical devices to generate a pulsated flow, a hydraulic pumping device is utilized. In such a system, pulsation is produced by a distribution valve which houses a rotor that is rotated by inlet water flow and distributes the inlet water to a series of outlets which are connected to the individual jets. The rotor is formed with a groove which sequentially aligns the water outlets to the water inlet. Since each outlet is periodically connected to and disconnected from the inlet, the water is supplied to each jet in a pulsating or chopped manner. Examples of this type of system are given in U.S. Pat. Nos. 5,444,879 and 5,457,825 to Michael D. Holtsnider and assigned to B&S Plastics, Inc., the assignee of the present invention.

While the hydraulic systems do provide a degree of pulsation, they too suffer from many of the same problems as the mechanical systems. For example, as the pulsation effect is generated away from the jet, the pulsed flow stream experiences pressure loss, resulting in a reduced pulsation effect at the jet, and like the mechanical systems, the additional componentry adds complexity, cost and weight to the system. Also, a larger water pump may be required to provide the additional energy necessary to rotate the rotor and to compensate for additional pressure losses.

To overcome the drawbacks associated with mechanical and hydraulic pulsed systems, pulsation systems have been designed that do not require mechanical devices or hydraulic distribution systems. Such systems generally have individual pulsation mechanisms located within the individual jets. For example, as shown in the Waterway "1997 Product Catalog", page 1, Deluxe and Octagon series pulsator jet, and U.S. Pat. No. 5,657,496 to Corb et al., also assigned to B&S Plastics, Inc., the individual jets contain rotational devices commonly called eyeballs. The eyeballs have one or more water conduits which discharge water flowing through the jet into the spa or tub. The conduits are angled to cause the eyeball to rotate and distribute the flow steam in a circular pattern. This circular distribution provides, to some degree, the sensation of a pulsed flow as the flow stream interacts with a specific point on the body is periodic fashion. However, this is not truly a pulsed flow since the user actually experiences a continual flow stream but yet in a circular pattern.

Attempts have been made to produce a jet that would produce a true pulsed flow. To this end several designs have been developed in which pulsation is created at the jet itself. In these systems, the flow stream at the jet is blocked periodically to create the sensation of a pulsed flow. See Waterway "1997 Product Catalog", page 1, Standard Poly Jets whirly and pulsator jets, and U.S. Pat. No. 4,508,665 to Spinnett. While both the Waterway and Spinnett jet designs do in fact produce a pulsed flow, the pulsing is created by blocking the flow stream exiting the rotary member as it rotates past a blocking device. When the flow stream comes in contact with the blocking member the flow is temporarily interrupted or halted, thus a pulsed flow. The pulsed flow generated is circular or spiral in nature, moving from one zone to another in a sequential manner. The blocking however creates an undesirable backflow into the jet, causing strain on the spa systems and ultimately lowering its efficiency. In addition, the Spinnett design requires multiple deflections of the flow stream as it passes through the jet, causing pressure losses and lowering the system efficiency.

SUMMARY OF THE INVENTION

The system includes a jet, a rotating member or "eyeball" and a diverter cap formed with a number of bore holes positioned at a common radius from the center of the cap. The jet produces a high pressure water jet that flows through the eyeball causing it to rotate at a high speed and discharge the jet in a circular pattern that impinges on the bore holes. The bore holes are formed in the diverter cap so that the upstream intersection of the bore holes forms a series of ridges that divert the rotating jet into the appropriate bore hole(s) without blocking the jet and producing a back flow and are aligned with the rotating eyeball to minimize pressure losses experienced by the jet. Together the rotation speed and bore hole design produce the sensation of a number of simultaneously pulsating water jets that are directed into the spa or tub.

These and other further features and advantages of the invention will be apparent to those skilled in the art from the following detailed description, taken together with the accompanying drawings, in which:

DETAILED DESCRIPTION OF THE INVENTION

Figure 1:
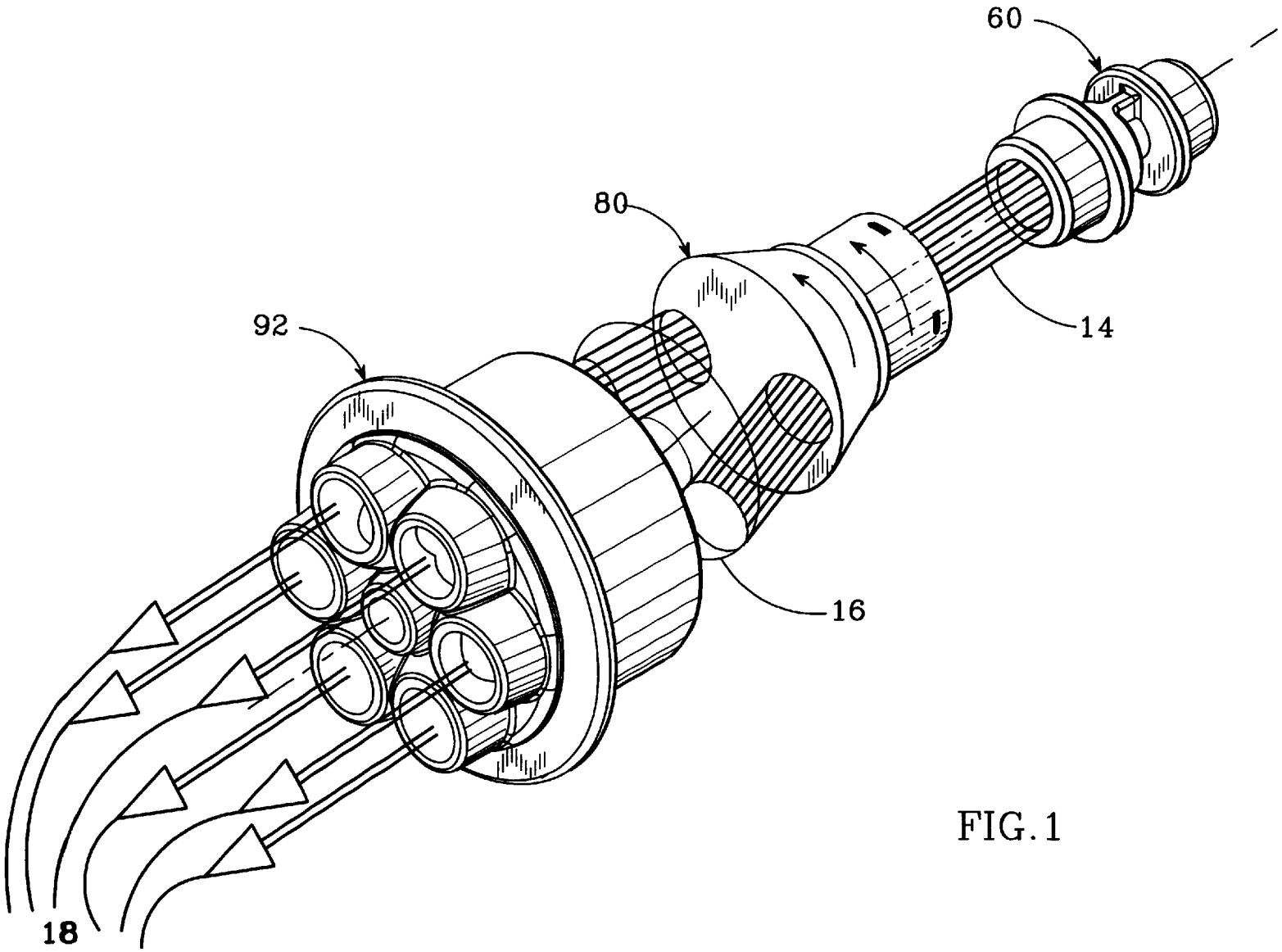
FIG. 1 is a simplified exploded view of a pulsating hydrotherapy jet system.

The invention relates to a low pressure loss hydrotherapy jet system 20 that uses a single water jet 60 to produce the sensation of multiple simultaneously pulsating jets. As shown in FIG. 1, this is accomplished by passing a water jet 14 through an eyeball 80 causing it to rotate and discharge the jet in a circular pattern 16 to a series of bore holes molded within a diverter cap 92. The upstream intersection of the bore holes creates a ridge which diverts the rotating jet into the respective bore holes without generating back flow. The eyeball is rotated fast enough that the user has the sensation of simultaneously pulsating jets 18. The system has the added advantage in that its design results in low pressure losses.

Figure 2:
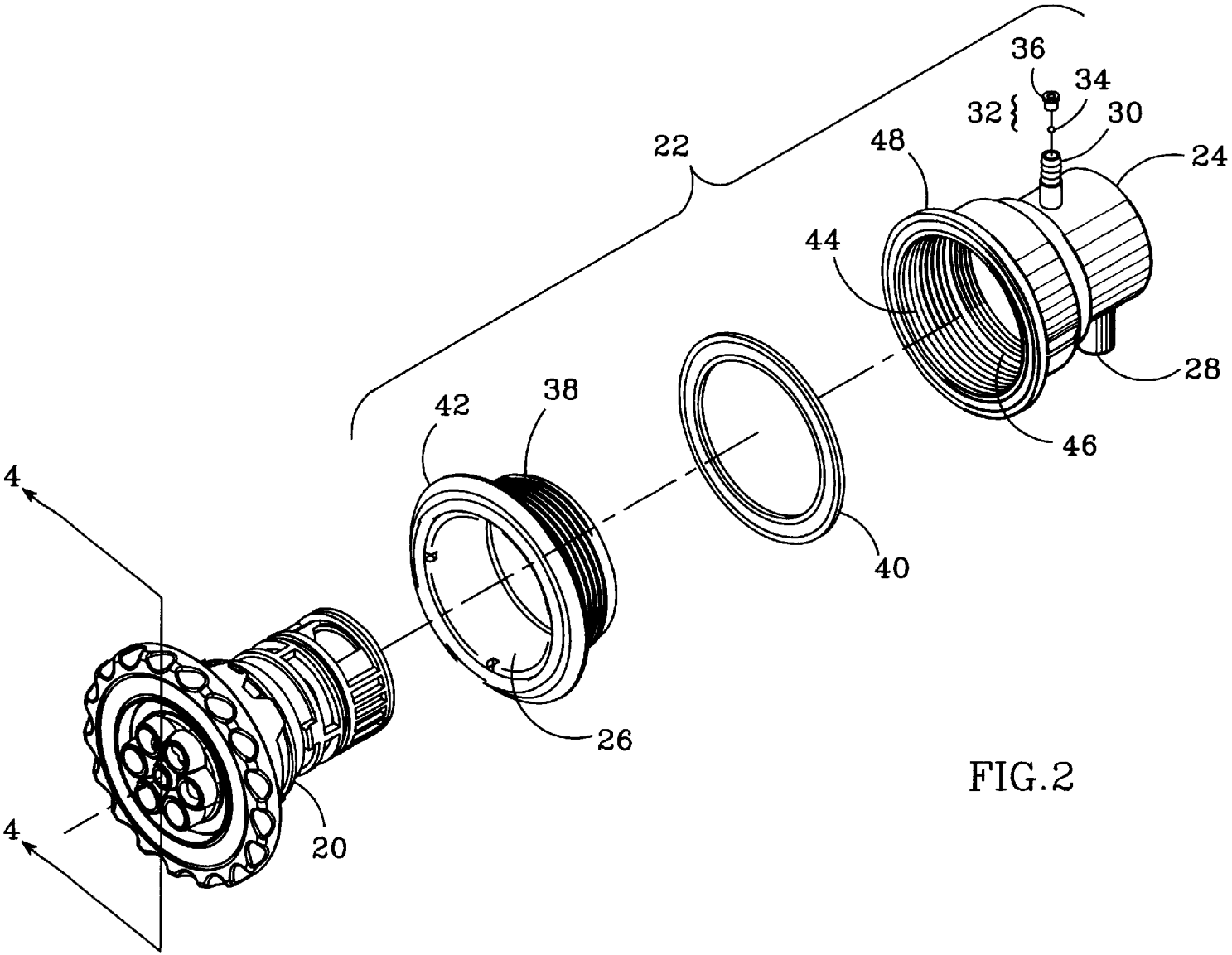
FIG. 2 is an exploded perspective view of a pulsating hydrotherapy jet system and mounting housing.

As shown in FIG. 2 pulsating hydrotherapy jet system 20 is enclosed within a housing 22 that has a rear body portion 24 that is threaded with a front body portion 26. The rear body portion 24 includes water and air conduits 28 and 30, respectively, that allow water and air to flow into jet 20. A check valve 32 in air conduit 30 prevents water from back flowing into an air supply system. Check valve 32 contains a check valve ball 34 which is held in place by a check valve ball retainer 36. In the event that water begins to back flow into the air system, ball 34 is forced against retainer 36 sealing off air conduit 30 and preventing further flow.

Front body portion 26 includes an exterior threading 38 and a front flange 42 located at the forward end of threading 38. A gasket 40 is slipped over threading 38. Rear body portion 24 includes interior threadings 44 and 46 and a forward flange 48. The jet system is held in place, protruding through an opening in the wall of the spa or tube, by sandwiching the spa or tub wall between gasket 40 and flange 48 and then threading external threads 38 into internal threads 44, until tight.

Jet 20 is mounted within housing 22 by threading a series of external threads located around the perimeter of jet 20 with internal threads 46 and tightening.

Figure 3:
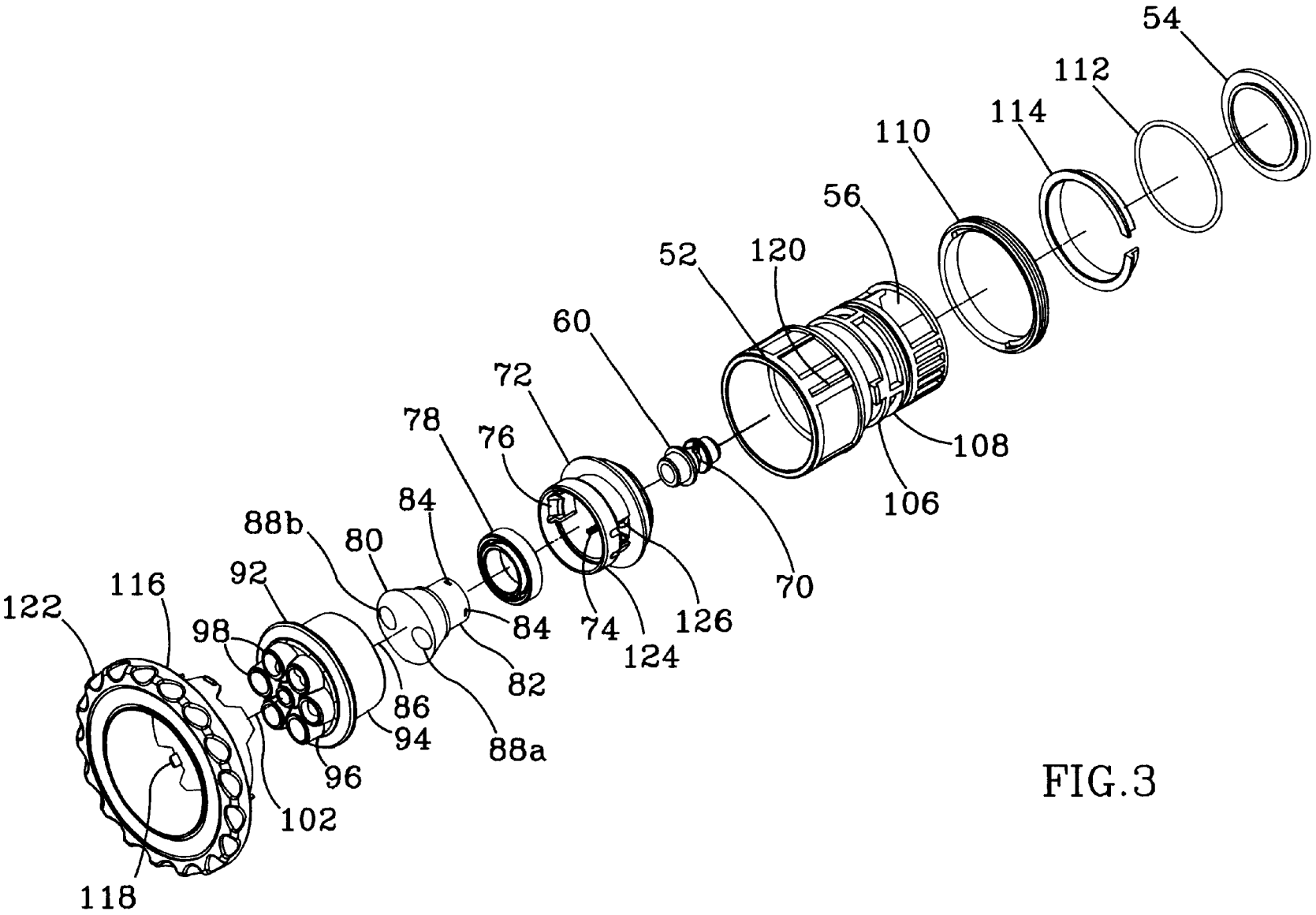
FIG. 3 is an exploded perspective view of the pulsating hydrotherapy jet system of FIG. 2.
Figure 4:
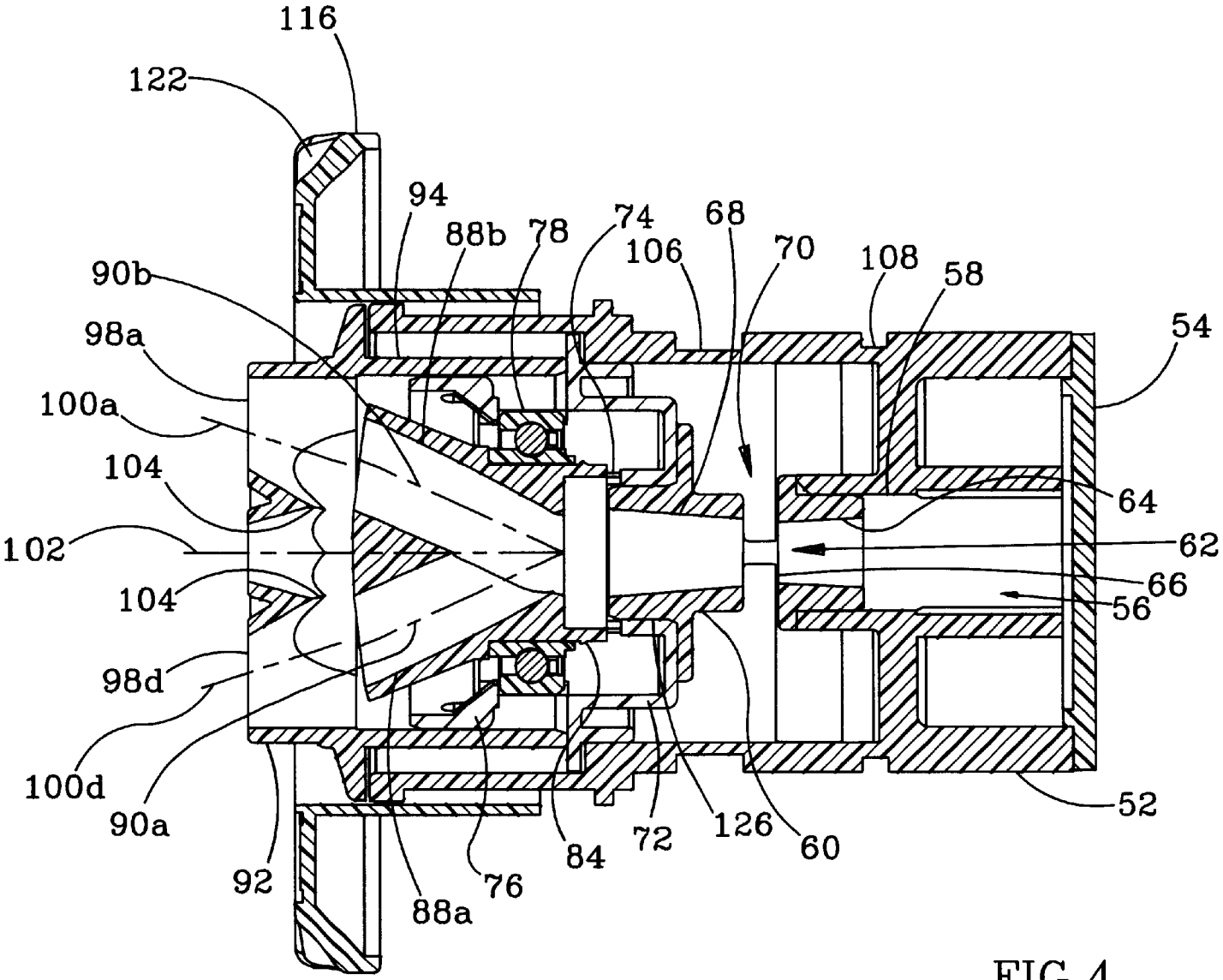
FIG. 4 is a sectioned elevation view of the pulsating hydrotherapy jet taken across lines 4—4 of FIG. 2.

The detailed construction of jet 20 including water jet 60, eyeball 80 and diverter cap 92 is depicted in FIGS. 3 and 4. Jet 20 receives water through conduit 28 and mixes it with air to produce a high pressure jet. Jet 20 includes a diverter 52 with a diverter plate 54 mated to its aft end forming a tapering sidewall channel 56 whose axis is parallel to that of water conduit 28. Channel 56 receives water flowing from conduit 28 constricting its flow and providing it to an exit port 58 whose axis is normal to that of channel 56 and coaxial with the longitudinal axis of diverter 52. Attached to exit port 58, at its upstream end is an water jet 60 which houses a venturi 62. Jet 60 is used to produce a high pressure water jet for the system. Venturi 62 has an upstream section 64 that tapers down to its smallest diameter at a throat 66. At the throat 66 venturi 62 expands in diameter forming an aft section 68. Aft of throat 66, in section 68, are located a series of air openings 70 used to aerate water flowing through venturi 62.

Attached to downstream end of venturi 62 is an eyeball carrier 72. Located within carrier 72 are a series of bearing support members 74 and bearing support clips 76 which position and hold a bearing 78.

Eyeball 80 is designed and mounted at the downstream end of venturi 62 so that the eyeball rotates when subjected to water flow. Bearing 78, preferably a ball bearing system, is mounted onto eyeball 80 by mating an inner race of bearing 78 with an eyeball sleeve 82 located on the upstream end of eyeball 80 and held in place by a series of tabs 84. The outer race of bearing 78 is mounted within carrier 72.

Eyeball 80 has a rotation axis 86 and two linear water conduits 88*a* and 88*b* passing through it. The conduits have longitudinal axes 90*a* and 90*b* which are offset from axis 86 by an angle $\theta$. Axes 90*a* and 90*b* are also offset by an angle $\alpha$ (not shown) from and at a non-intersecting orientation to the rotation axis 86. The offset provides a turning moment to eyeball 80 in response to a jet flow. The jet flow exiting eyeball 80 traces out a circular pattern 16 which is perceived to be a solid ring of water.

Located downstream of eyeball 80 is diverter cap 92 which diverts the water flowing from eyeball 80 to produce the simultaneous pulsating jets. Diverter cap 92 includes a cylindrical sleeve 94 molded to a face plate 96 which contains a series of six conical bore holes 98*a* through 98*f* with corresponding longitudinal axes 100*a* through 10*f*. The bore holes are displaced at a common radial distance from the cap's longitudinal axis 102, i.e. in a circle. Axes 100*a* through 100*f* are offset from axis 102 by a common angle $\beta$ such that the bore holes are aligned with and does not substantially alter the flow from conduits 88*a* and 88*b*.

Upstream of bores 98*a* through 98*f* at the intersection of the bores are a series of ridges 104*a* through 104*f* forming a knife like edge between the bore holes. The ridges divert water provided from conduits 88*a* and 88*b* into one or more of bore holes 98*a* through 98*f*. The knife like edge acts to cut the water, diverting it into the bore holes. The cutting action allows the water to flow into bore holes without producing back flow as would be the case if the surfaces were flat.

A locking thread ring 110 and a O-ring 112 are located on the outside perimeter of diverter 52 to respectively lock jet 20 into housing 22 and to provide a corresponding water tight seal. A locking thread ring 110 and an O-ring 112 are respectfully seated in a series of axial grooves 106 and 108 located around the perimeter of diverter 52. Locking ring 110 is held in place by the use of a snap ring 114 that is seated in grove 106.

An escutcheon 116 is attached to the forward end of diverter 52 such that the rotation of escutcheon 116 results in the rotation of jet 20 and in turn the regulation of the flow of water into jet 20 from water conduit 28. Escutcheon 116 is which is held in place by a series of locking tabs 118 which mate with a series of locking slots 120 located around the perimeter of diverter 52. Locking tabs 118 are seated into locking slots 120 and permit escutcheon 116 to slide along diverter 52 to compensate for differing tub or spa wall thickness. Located around the perimeter of escutcheon 116 are a series of scallops 122 used to facilitate its rotation.

Figure 5:
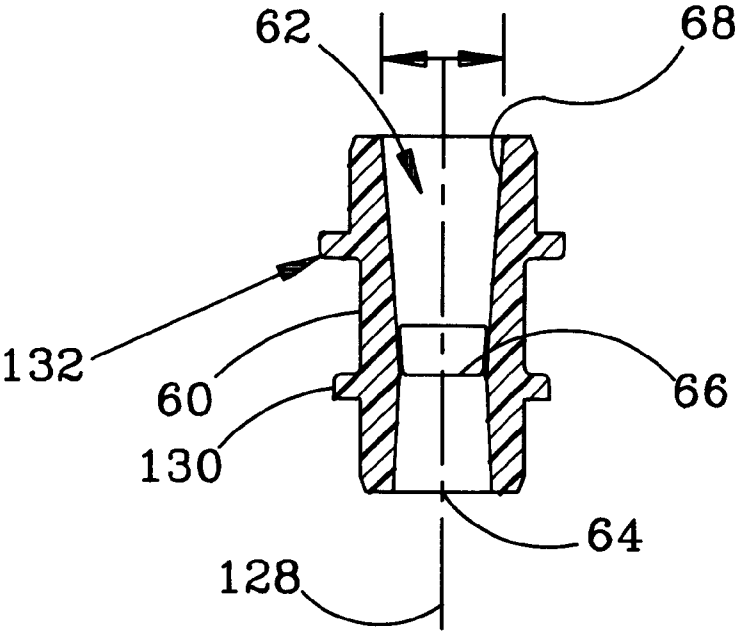
FIG. 5 is a sectioned elevation view of the water jet used in the pulsating hydrotherapy jet system as viewed in same direction as FIG. 4.

As further shown in FIG. 5, jet 60 contains venturi 62 which consists of upstream conical section 64, circular throat 66 and aft conical section 68 that all share a common longitudinal axis 128. Section 64 has a decreasing taper which reaches its smallest diameter at throat 66 so that water flowing through upstream section 64 is gradually constricted, causing a drop in pressure and increase in flow rate, until reaching a maximum constriction at throat 66. Aft of throat 66 venturi 62 expands forming aft section 68 where the flow stream is expanded, increasing the fluid pressure and decreasing its flow rate. The expansion is controlled by the conical walls of section 68, providing low flow stream pressure loss. The pressure differential creates a low pressure area where a series of air openings 70 (not shown) are used to aerate water flowing through venturi 62. Openings 70 are in the form of two parallel slots normal to axis 128 and displaced from one another by a distance (preferably about 3.175 mm) leaving two rib like structures remaining. External to jet 60 are two circumferential flanges 130 and 132 which are used to create a water tight seal when jet 60 is mated with exit port 58 and bore 126.

The appropriate flow rate and pressure are set by the ratio of the tapers in section 64 and 68. The taper for outlet section 68 should be at least 1.5 times the taper of the inlet portion 64, and preferably about 4.4°. The pressure and flow rate exiting section 68 of venturi 62 are preferably approximately 55 kPa to about 110 kPa at a flow rate of approximately 50 to 80 liters per minute. The addition of a conical section aft of throat 66 provides a method for controlled expansion of the flow stream which results in increased pressure while minimizing pressure loss as compared to known systems.

Figure 8:
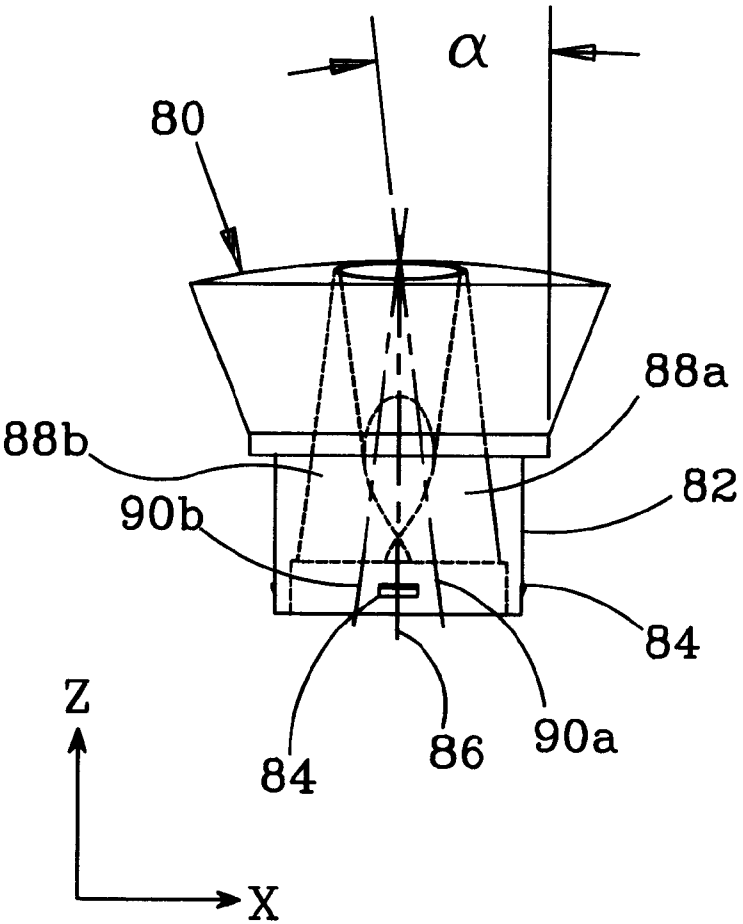
FIG. 8 is an elevation view of the eyeball of FIG. 6 displaying the angular offsets of its water conduits.
Figure 7:
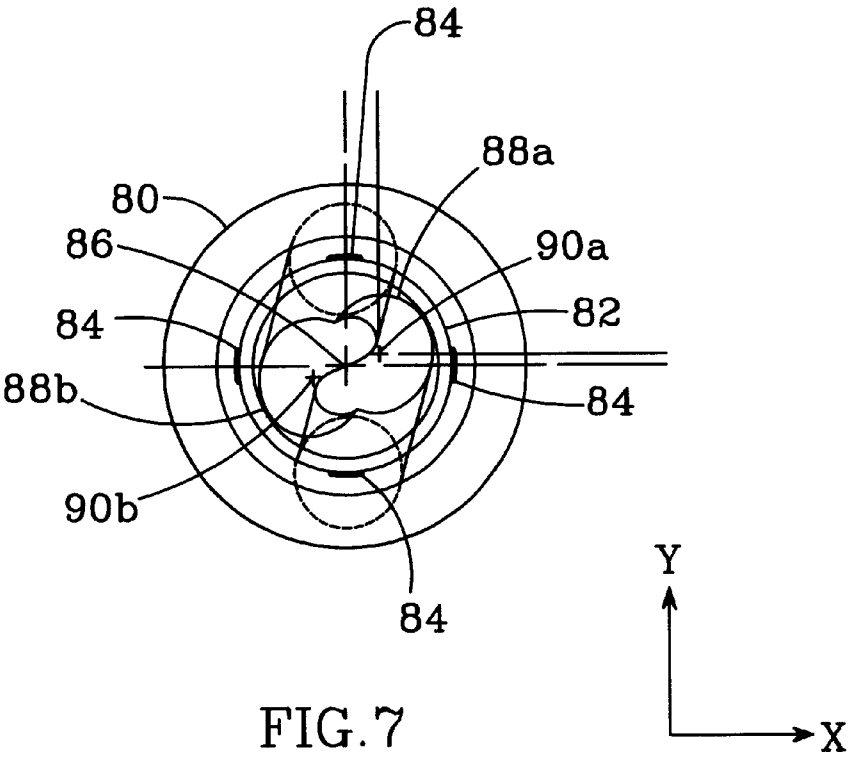
FIG. 7 is a plan view of the eyeball of FIG. 6 displaying the displacement at the upstream end of its water conduits.
Figure 6:
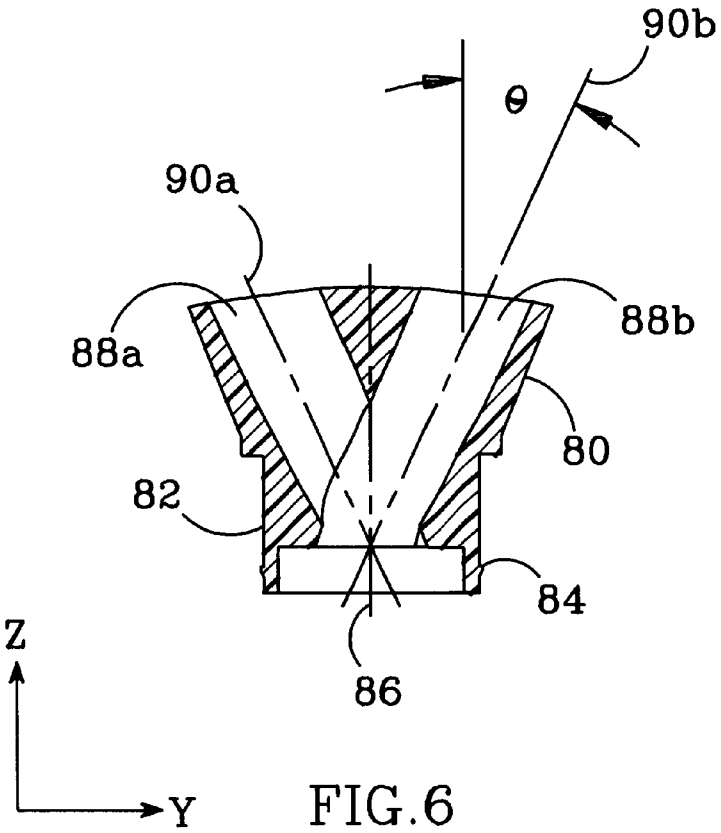
FIG. 6 is a sectioned elevation view of the eyeball used in the pulsating hydrotherapy jet system as viewed in the same direction as FIG. 4.

As shown in FIGS. 6, 7 and 8, linear water conduits 88*a* and 88*b* passing through eyeball 80 and are spaced 180° apart from one another about axis 86. The conduits' longitudinal axes 90*a* and 90*b* are oriented at an angle θ (preferably about 25°) to the axis 86. Axes 90*a* and 90*b*, at their upstream end, are offset from axis 86 in two orthogonal directions, by a distance in the "x" direction, preferably about 1.37 mm, and a distance in the "y" direction, preferably about 3.96 mm. At the downstream end, axes 90*a* and 90*b* are co-planer with axis 86 but offset by about 13.74 mm relative to axis. Axes 90*a* and 90*b* are further offset by an angle α (preferably about 7°) from and at a non-intersecting orientation to the rotation axis 86 to provide a turning moment to the eyeball in response to a jet flow. Angles θ and α are set such that the eyeball obtains sufficient rotary speed to provide what is perceived to be a continuous solid circular band of water. The interaction of the water band with the diverter cap 92 ultimately provides the user with the sensation of simultaneously pulsing water jets. Conduits 88*a* and 88*b* should have a diameter that is greater then or equal to the largest diameter of section 68 to provide low pressure loss.

Figure 10:
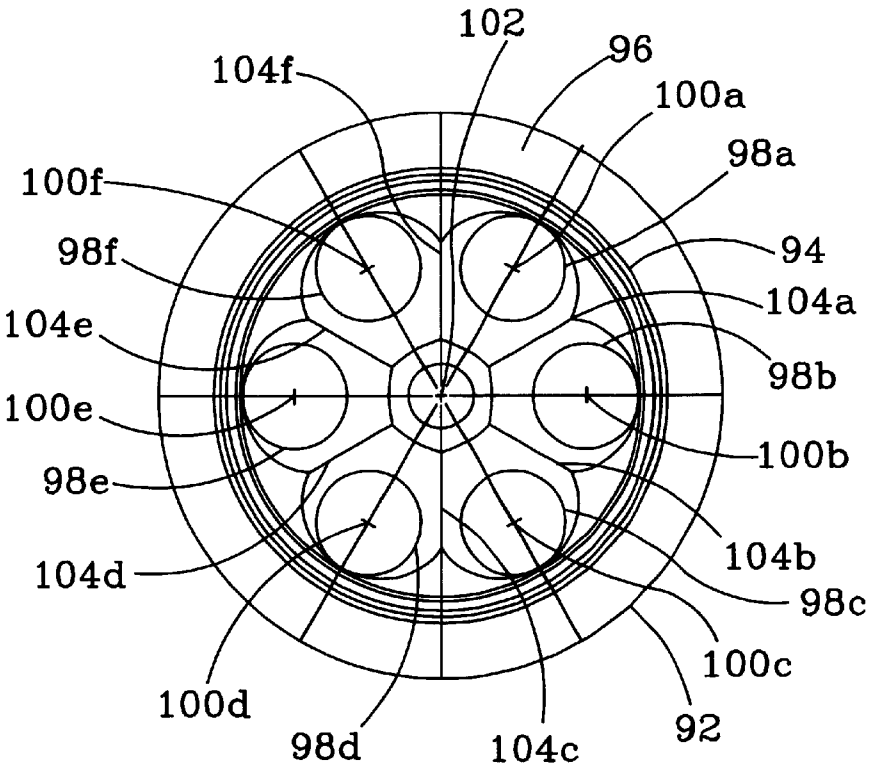
FIG. 10 is a plan view of the diverter cap used in the pulsating hydrotherapy jet system displaying the upstream ridge structure between each bore.
Figure 9:
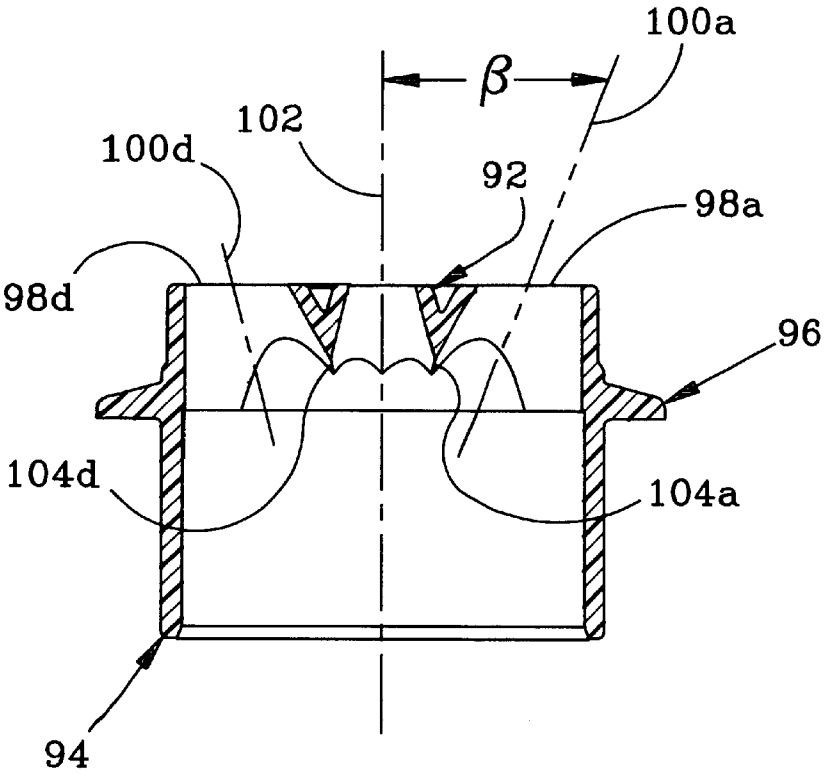
FIG. 9 is a sectioned elevation view of the diverter cap used in the pulsating hydrotherapy jet system as viewed in same direction as FIG. 4.

As shown in FIG. 9 and FIG. 10, diverter cap 92's cylindrical sleeve 94 is molded to face plate 96. Six conical bores 98*a* through 98*f* (preferably with a 30° taper) are displaced at a common radial distance from the cap's longitudinal axis 102. Bore holes axes 100*a* through 100*f* are offset from axis 102 by an angle β (preferably about 15°) such that the bore holes do not substantially alter the flow from conduits 88*a* and 88*b*. The intersection of bore holes 98*a* through 98*f* form a series of upstream ridges 104*a* through 104*f* that divert water from conduits 88*a* and 88*b* into one or more of the bore holes without generating back flow. Thus, rotary eyeball 80 discharges water flowing down conduits 88*a* and 88*b* to bore holes 98*a* through 98*f* in a sequential fashion with ridges 104*a* through 104*f*, where necessary, diverting the flow stream into the bore holes, without back flow, and ultimately providing the user with the sensation of a series of simultaneously pulsating jets.

In assembly, as shown in FIGS. 3 and 4, an inner race of bearing 78 is first mated with sleeve 82, held in place by tabs 84. An outer race of bearing 78 is then clipped into carrier 72 by the use of bearing support clips 76 and further held in place by bearing support members 74. Diverter cap 92 is then mated with carrier 72 by bonding an upper ring 124 located on cap 72 to the inner surface of cylindrical sleeve 94, preferably by the use of an adhesive. Jet 60 is inserted into a central bore 126 located in the upstream end of carrier 72, and preferably bonded in place by the use of an adhesive to create a water tight seal. The upstream end of jet 60 is inserted into exit port 58, again preferably held in place by an adhesive to crate a water tight seal. The diverter plate 54 is bonded to diverter 52, preferably by the use of an adhesive. Thread ring 110 is slid over the upstream end of diverter 52 and mated with axial groove 106, followed by snap ring 114 locking thread ring 110 in place. O-ring 112 is placed in axial groove 108. Escutcheon 116, via locking tabs 118, is clipped into locking slots 120 completing the assembly of jet 20.

Jet 20 is then mated with housing 22 by threading thread ring 110 into interior threads 46. Jet 20 is threaded into housing 22 by the rotation of escutcheon 116 until jet 20 is affixed tightly in place. Once affixed in place, jet 20 can be rotated by grasping scallops 122 and rotating escutcheon 116 through an arc of about 180° to adjust the volume of water discharged from jet 20. When jet 20 is positioned at one end of its rotational limit, water flowing through conduit 28 flows directly into channel 56 and is diverted through exit port 58 into jet 60. When jet 20 is positioned at its other rotational limit, water conduit 28 and channel 56 are not in alignment, prohibiting water to flow into jet 20. Intermediate levels of water flow can be established by rotating escutcheon 116, and in turn jet 20, to an intermediate position between the limits of its rotation.

In operation, water from the spa or tubs pump system flows through piping into water conduit 28 where it in turn flows into channel 56. Water in channel 56 is diverted into exit port 58 and into jet 60 where it flows through venturi 62. Water entering venturi 62 flows through throat 66 where it is aerated by the introduction of air from openings 70. Water leaving venturi 62 flows through section 68 where the flow stream is expanded in a controlled fashion. The controlled expansion increases the flow streams pressure while providing low pressure loss. The flow stream exits jet 60 at a pressure of approximately 55 kPa to about 110 kPa and at a flow rate of approximately 50 to 80 liters per minute.

Water exiting jet 60 flows directly into the upstream end of eyeball 80 and through its linear conduits 88*a* and 88*b*. The flow stream entering conduits 88*a* and 88*b* is diverted at an angle of approximately 30° providing a turning moment to eyeball 80. As a result, eyeball 80 rotates at speed of approximately 500 to 600 revolutions per minute and provides a exit flow stream that is in effect a continuous solid circular water ring. The flow stream exiting eyeball 80 encounters conical bore holes 98*a* through 98*f* which are provided at an angle similar to that of the flow stream to provide low pressure loss. As eyeball 80 is rotated from one bore to another, the flow stream encounters ridges 104*a* through 104*f* which divert the flow into one or more of the bore holes without causing back flow or its associated pressure loss. The diversion of water by the ridges 104*a* through 104*f* produces in what is perceived to be a pulsed water flow. The pulsed flow coupled with the speed of rotation of eyeball 80 produces the effect of simultaneously pulsating water jets. Jet 20 not only provides a hydrotherapy jet that gives the sensation of simultaneously pulsating jets, but does so with lower pressure losses then known systems.

Figure 11:
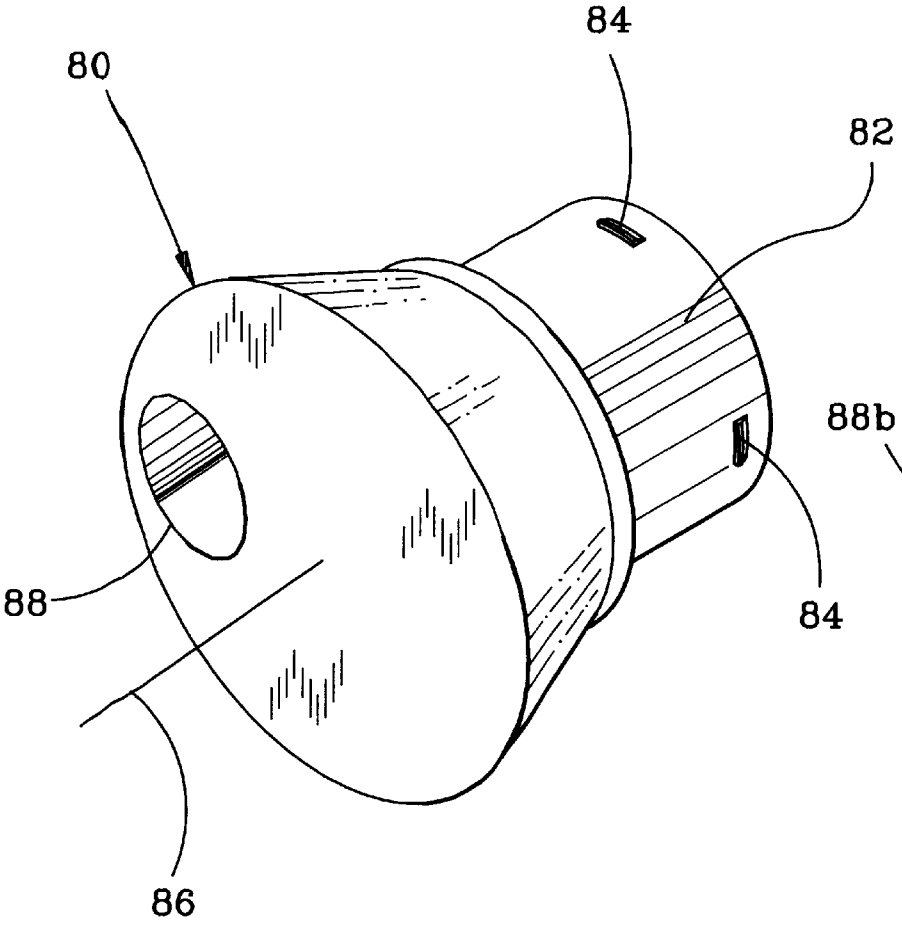
FIG. 11 is a perspective view of an alternate eyeball incorporating a single angled water conduit.

In an alternate configuration of the pulsing hydrotherapy jet system, as shown in FIG. 11, eyeball 80 may contain a singular water conduit 88.

Figure 12:
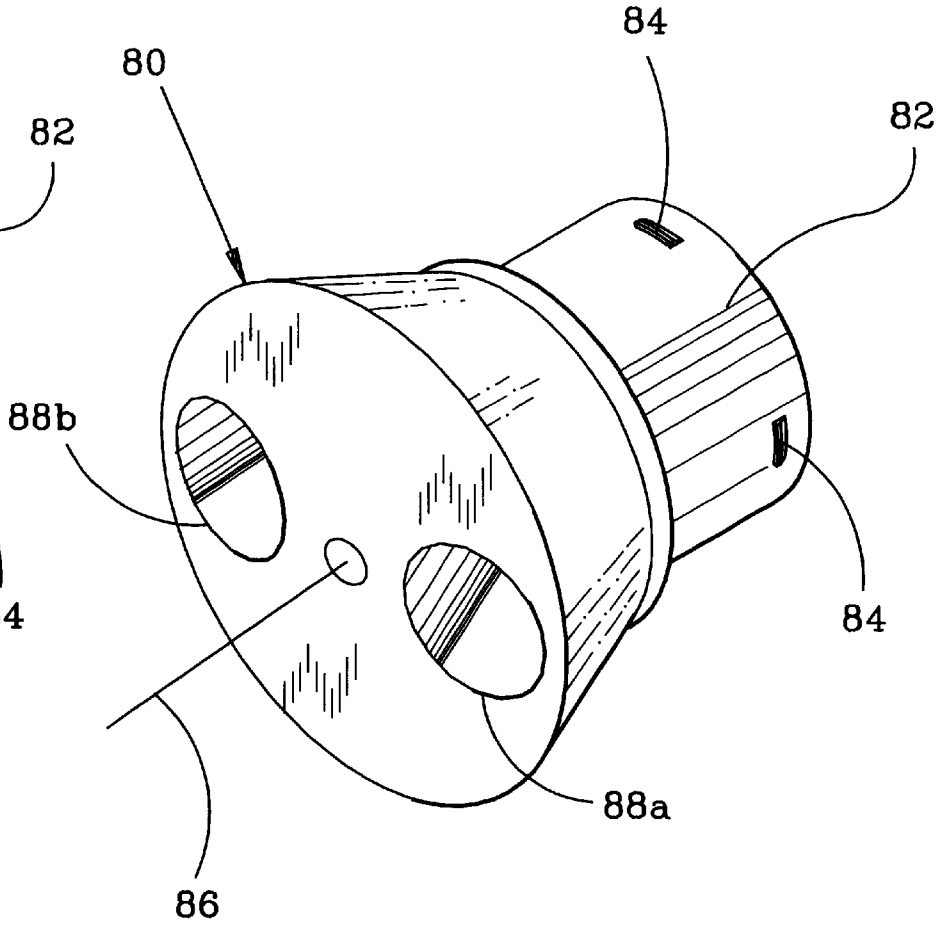
FIG. 12 is a perspective view of an alternate eyeball incorporating an additional water conduit which is coaxial with the longitudinal axis of the eyeball.

In a second alternate configuration of the pulsating hydrotherapy jet system, as shown in FIG. 12, eyeball 80 may contain a centralized water conduit 134, coaxial with axis 86, which provides a continuous, non-pulsating, jet to the user in addition to the series of pulsating jets.

Figure 13:
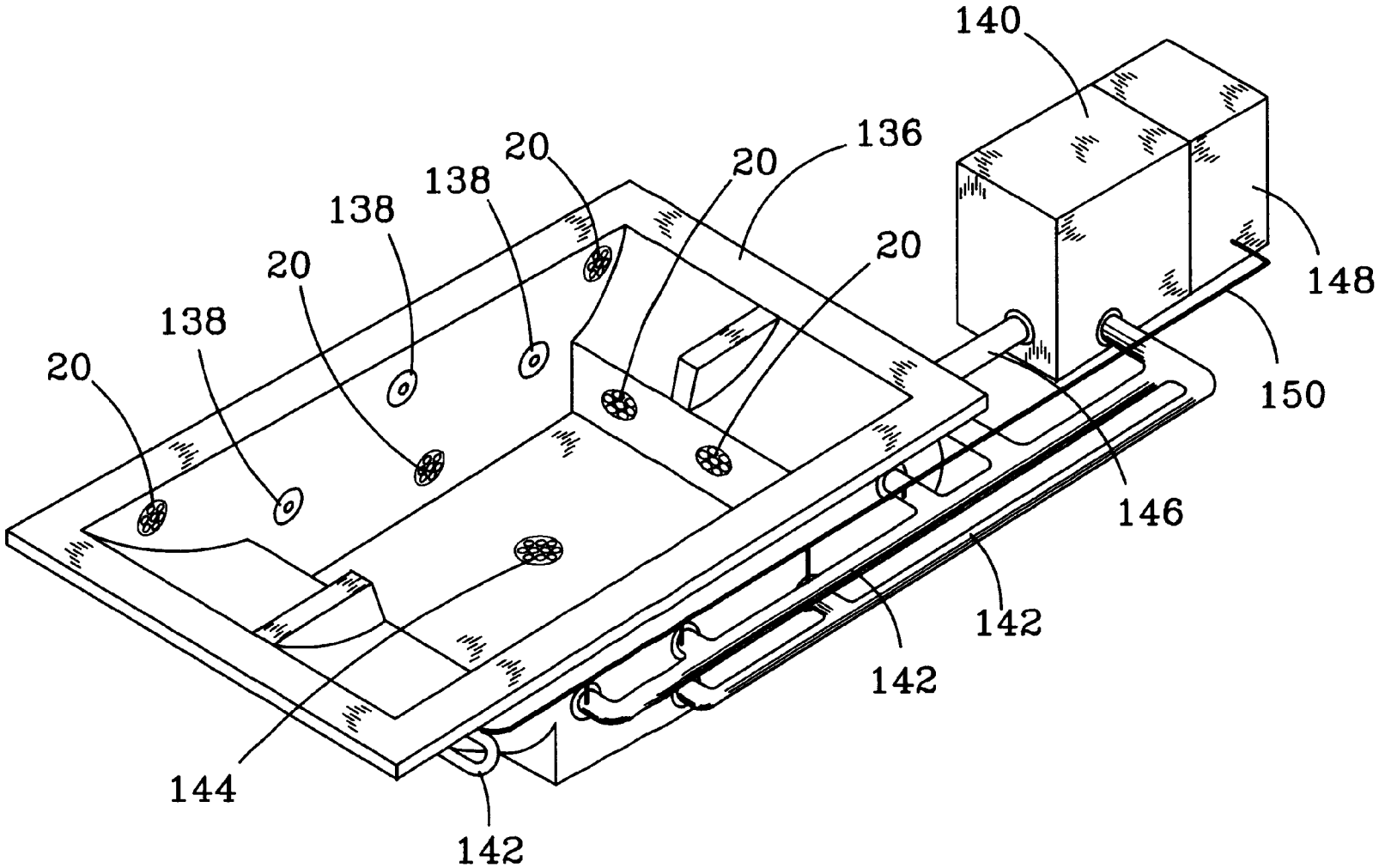
FIG. 13 is a perspective view of a spa system utilizing a series of pulsating hydrotherapy jets.

As shown in FIG. 13, multiple jets can be installed in a spa or tube shell 136 with all or some of the jets being a pulsating jet 20. The remaining jets can be a variety of known jets 138. Both types of jets are connected to a water pump system 140, which is used to circulate the water throughout the spa system by a series of water conduits 142. Water from shell 136 is provided to pump 140 through a drain 144 which is connected to a return water conduit 146 and back to pump 140. Water from pump 140 is provided back to shell 136 by conduit 142, where it flows into jets 20 or 138, as the case may be, and in turn into shell 136, completing the loop. Additionally, an air system 148 can be included that provides air to individual jets 20 and 138, by an air conduit 150, to aerate the water flowing through the jet. System 148 can be pump driven to increase the pressure of the air enter the jets, or the system can be vacuum based in which the venturi located within the jets draw the air into the water flow stream.

Although the present invention has been described in considerable detail with reference to certain preferred configurations thereof, other versions are possible. Therefore, the spirit and scope of the appended claims should not be limited to their preferred versions contained therein.

I claim:

1. A pulsating hydrotherapy jet, comprising:

a jet body;

a water inlet in said body;

a water passageway within said body for forming water flowing through said inlet into a jet;

a rotary member rotatably mounted in said body about a rotation axis for receiving said jet, said rotary member having a conduit oriented with respect to its rotation axis at which the flow of said jet imparts a turning moment to said member that causes it to rotate and discharge a jet along a conduit axis so that the jet traces out a circular pattern; and a diverter cap mounted on said body to receive said jet as it traces out the circular pattern, said cap having a plurality of bore holes that are displaced at a common radial distance from the center of said cap, said bore holes intersecting to form tapered ridges that divert said jet flow from one bore hole to the next as said jet traces out the circular pattern providing the sensation of multiple simultaneously pulsating jets without producing a back flow.

2. The hydrotherapy jet of claim 1, wherein said passageway includes a venturi having a tapering inlet section and a tapering outlet section the taper of said outlet section being at least 1.5 times the taper of said inlet section.

3. The hydrotherapy jet of claim 2, wherein the largest cross-sectional area of said outlet section of said venturi is smaller then or equal to the cross-sectional area of the conduit of said rotary member.

4. The hydrotherapy jet of claim 2, wherein said jet exiting said outlet section of said venturi is at a pressure of at least 150 kilopascal.

5. The hydrotherapy jet of claim 1, wherein said rotary member comprises at least one conduit formed at an offset from said rotary members axis of rotation to permit said member to rotate at a speed of at least 500 revolutions per minute.

6. The hydrotherapy jet of claim 5, wherein said rotary member has a conduit whose axis is coaxial with that of said rotary members axis of rotation.

7. The hydrotherapy jet of claim 1, wherein said rotary member comprises at least one conduit formed at an offset and whose axis is non-parallel to said rotary members axis of rotation, and wherein said conduit axis is displaced 25 degrees or more in a direction co-plainer with that of said rotary member axis of rotation and further displaced 6 degrees or more in a direction normal to said plane.

8. The hydrotherapy jet of claim 1, wherein said cap's bore holes are tapered forming a conical section each having a central longitudinal axis.

9. The hydrotherapy jet of claim 8, wherein the intersection of said conical sections on said cap form said tapered ridges for diverting said jet flow between said bore holes without producing back flow of said jet.

10. The hydrotherapy jet of claim 8, wherein said central axis of said conical section is substantially aligned with said conduit axis.

11. The hydrotherapy jet of claim 1, wherein said cap further contains a central bore hole whose axis is coaxial with that of said cap.

12. The hydrotherapy jet of claim 1, wherein the flow rate of said jet rotates said rotary member at a sufficient rate such that the jet flow from said rotary member is in effect a solid ring, the interaction of said solid ring with said cap bore holes producing the sensation of simultaneously pulsating jets.

13. A spa system, comprising:

a spa shell that is capable of holding water;

a plurality of pulsating hydrotherapy jets mounted around said spa shell in which each said jet provides the sensation of multiple simultaneously pulsating jets;

a water pump system that circulates water throughout said spa by providing water to said jets and receiving water from said spa shell;

a series of water conduits that provide water to said jets and receive water from said spa shell;

each said pulsating hydrotherapy jet, comprises:

a jet body;

a water inlet in said body;

a water passageway within said body for forming water flowing through said inlet into a jet;

a rotary member rotatably mounted in said body about a rotation axis for receiving said jet, said rotary member having a conduit oriented with respect to its rotation axis at which the flow of said jet imparts a turning moment to said member that causes it to rotate and discharge a jet along a conduit axis so that the jet traces out a circular pattern; and a diverter cap mounted on said body to receive said jet as it traces out the circular pattern, said cap having a plurality of bore holes that are displaced at a common radial distance from the center of said cap, said bore holes intersecting to form tapered ridges that divert said jet flow from one bore hole to the next as said jet traces out the circular pattern providing the sensation of multiple simultaneously pulsating jets without producing a back flow.

14. The system of claim 13, wherein said passageway includes a venturi having a tapering inlet section and a tapering outlet section the taper of said outlet section being at least 1.5 times the taper of said inlet section.

15. The system of 13, wherein said conduit axis is displaced 25 degrees or more in a direction co-plainer with that of said rotary member axis of rotation and further displaced 6 degrees or more in a direction normal to said plane.

16. The system of claim 13, wherein said cap's bore holes are tapered forming a conical section each having a central longitudinal axis, the intersection of said conical sections on said cap form said tapered ridges for dividing said jet flow between said bore holes without producing back flow of said jet, and wherein said central axis of said conical section is substantially aligned with said conduit axis.

17. The hydrotherapy jet of claim 13, wherein the flow rate of said jet rotates said rotary member at a sufficient rate such that the jet flow from said rotary member is in effect a solid ring, the interaction of said solid ring with said cap bore holes producing the sensation of simultaneously pulsating jets.

18. A pulsating hydrotherapy jet, comprising:

a diverter cap formed with multiple bore holes that are positioned at a common radius from the center of the cap and which intersect to form tapered ridges between said holes;

an eyeball rotatably mounted about a rotation axis upstream of the diverter cap, said eyeball having a conduit that is oriented at an angle to said rotation axis; and a jet that produces a water jet that flows through the eyeball's conduit causing the eyeball to rotate and discharge the jet in a circular flow, the pressure of said water jet and the angle of said conduit producing a sufficiently high rotational speed that the circular flow is perceived as a solid ring of water, said tapered ridges interacting with said solid ring of water to produce the sensation of multiple simultaneously pulsating jets without producing a back flow.

19. The hydrotherapy jet of claim 18, wherein said jet includes a venturi having a tapering inlet section and a tapering outlet section the taper of said outlet section being at least 1.5 times the taper of said inlet section.

20. The hydrotherapy jet of claim 19, wherein said jet exiting said outlet section of said venturi is at a pressure of at least 150 kilopascal.

21. The hydrotherapy jet of claim 19, wherein said eyeball's conduit formed at an offset from said rotary members axis of rotation to permit said member to rotate at a speed of 500 revolutions per minute or more.

22. The hydrotherapy jet of claim 19, wherein said rotary member comprises at least one conduit formed at an offset and whose axis is non-parallel to said rotary members axis of rotation, and wherein said conduit axis is displaced 25 degrees or more in a direction co-plainer with that of said rotary member axis of rotation and further displaced 6 degrees or more in a direction normal to said plane.

* * * * *